US011624264B2

(12) United States Patent
Al-Marri

(10) Patent No.: US 11,624,264 B2
(45) Date of Patent: Apr. 11, 2023

(54) CONTROLLING CORROSION WITHIN WELLBORES

(71) Applicant: Saudi Arabian Oil Company, Dhahran (SA)

(72) Inventor: Hamad Al-Marri, Al-Hofuf (SA)

(73) Assignee: Saudi Arabian Oil Company, Dhahran (SA)

( * ) Notice: Subject to any disclaimer, the term of this patent is extended or adjusted under 35 U.S.C. 154(b) by 88 days.

(21) Appl. No.: 17/071,854

(22) Filed: Oct. 15, 2020

(65) Prior Publication Data

US 2022/0120163 A1 Apr. 21, 2022

(51) Int. Cl.

| | |
|---|---|
| ***E21B 41/02*** | (2006.01) |
| ***E21B 49/08*** | (2006.01) |
| ***E21B 47/07*** | (2012.01) |
| ***E21B 34/16*** | (2006.01) |
| ***E21B 47/12*** | (2012.01) |

(52) U.S. Cl.

CPC ..... *E21B 41/02* (2013.01); *E21B 34/16* (2013.01); *E21B 47/07* (2020.05); *E21B 49/0875* (2020.05); *E21B 47/12* (2013.01); *E21B 49/084* (2013.01)

(58) Field of Classification Search

CPC ..... E21B 41/02; E21B 34/16; E21B 47/07; E21B 49/0875; E21B 49/087; E21B 49/088; E21B 49/08; E21B 47/12; E21B 47/138; E21B 49/084; E21B 43/14; E21B 47/00; E21B 47/006

See application file for complete search history.

(56) References Cited

U.S. PATENT DOCUMENTS 4,378,048 A * 3/1983 Madgavkar ..... E21B 43/243 166/266
4,390,061 A * 6/1983 Short ..... E21B 43/124 166/372

(Continued)

FOREIGN PATENT DOCUMENTS

WO WO 2008150811 12/2008
WO WO-2008150811 A1 * 12/2008 ..... E21B 37/06

OTHER PUBLICATIONS

PCT International Search Report and Written Opinion in International Appln. No. PCT/US2021/054798, dated Feb. 9, 2022, 16 pages.

(Continued)

*Primary Examiner* — Nicole Coy
*Assistant Examiner* — Nicholas D Wlodarski
(74) *Attorney, Agent, or Firm* — Fish & Richardson P.C.

(57) ABSTRACT

A method for controlling corrosion is described. The method includes determining a concentration of a first gas in a first formation, determining a concentration of a second gas different than the first gas in a second formation, determining a ratio between the first gas and the second gas, comparing the determined ratio to a threshold ratio of the first gas to the second gas for the wellbore which reduces a corrosion rate within the wellbore, and based on a result of comparing the determined ratio to the threshold ratio, modifying a quantity of the first formation fluid or the second formation fluid flowed into the wellbore. The first gas and the second gas mix within the wellbore.

15 Claims, 2 Drawing Sheets

(56) References Cited

U.S. PATENT DOCUMENTS 4,416,333 A * 11/1983 Mundhenk ..... C23F 11/00 166/371
4,505,155 A * 3/1985 Jackson ..... E21B 47/06 73/714
4,568,933 A * 2/1986 McCracken ..... E21B 47/12 340/855.8
4,635,735 A * 1/1987 Crownover ..... E21B 49/08 175/48
4,779,679 A * 10/1988 Snavely, Jr. ..... E21B 41/02 507/224
6,149,344 A * 11/2000 Eaton ..... B01D 53/002 405/129.28
6,176,323 B1 * 1/2001 Weirich ..... E21B 49/005 175/40
6,268,911 B1 * 7/2001 Tubel ..... E21B 33/1275 356/326
6,325,147 B1 * 12/2001 Doerler ..... E21B 43/20 166/266
6,491,102 B2 * 12/2002 Leismer ..... E21B 44/005 166/374
7,526,953 B2 * 5/2009 Goodwin ..... E21B 49/08 73/152.28
9,029,762 B2 * 5/2015 Shen ..... E21B 49/081 250/269.1
9,062,521 B2 * 6/2015 Steele ..... E21B 34/00
2011/0088895 A1 * 4/2011 Pop ..... E21B 7/04 166/254.2
2015/0012219 A1 * 1/2015 Selman ..... E21B 47/06 702/9
2018/0058209 A1 * 3/2018 Song ..... E21B 47/107

OTHER PUBLICATIONS

Andrews et al., "Real-Time Downhole Zonal Gas Composition Tool for Production Logging," IPTC-19990-Abstract, International Petroleum Technology Conference, Jan. 2020, 6 pages.

Lingfeng et al., "Optimization on sizes and material selection of tubing for preventing corrosion in sour gas field under coexistence of H 2 S and CO2," Journal of Chemical and Pharmaceutical Research, 5(9): 555-562, Jan. 2013, 8 pages.

Yufei et al., "Completion difficulties of HTHP and high-flowrate sour gas wells in the Longwangmiao Fm gas reservoir, Sichuan Basin, and corresponding courtmeasures," Natural Gas Industry B, 3(3): 269-273, May 2016, 5 pages.

* cited by examiner

CONTROLLING CORROSION WITHIN WELLBORES

TECHNICAL FIELD

This disclosure relates to wellbore corrosion.

BACKGROUND

Formations of the Earth are filled with both liquid and gaseous phases of various fluids and chemicals including water, oils, and hydrocarbon gases. A wellbore in an oil and gas well extends from the surface of the Earth downward to geologic formations of the Earth. The wellbore conducts the fluids and chemicals from the formations of the Earth to the surface of the Earth through a tubular. Once on the surface of the Earth, the fluids and chemicals can be stored or transported for refining into useable products. The fluids and chemicals can also be conducted directly to a fluid separation and refining facility through pipes. Some of the chemicals can cause corrosion of metal wellbore and refining facility components.

SUMMARY

This disclosure describes technologies related to a method and systems of controlling corrosion within wellbores, for example, tubulars positioned within wellbores to conduct wellbore fluids. Implementations of the present disclosure include a method for corrosion control with wellbore fluids. The corrosion control method includes determining a concentration of a first gas in a first formation fluid flowed from a first formation into a wellbore formed from a surface of the Earth to the first formation. The method further includes determining a concentration of a second gas different from the first gas, the second gas in a second formation fluid flowed from a second formation adjacent the first formation into the wellbore, wherein the first gas and the second gas mix within the wellbore. The method further includes determining a ratio of a first gas concentration to a second gas concentration within the wellbore with a controller. In some implementations, determining the ratio of the first gas concentration to the second gas concentration within the wellbore further includes sensing a second concentration of the first gas within the wellbore, transmitting a signal representing the second concentration of the first gas to the controller, sensing a second concentration of the second gas within the wellbore, and transmitting a signal representing the second concentration of the second gas to the controller. The method further includes comparing the determined ratio to a threshold ratio of the first gas concentration to the second gas concentration for the wellbore which reduces a corrosion rate within the wellbore with the controller. The method further includes, based on a result of comparing the determined ratio to the threshold ratio, modifying a quantity of the first formation fluid or the second formation fluid flowed into the wellbore with the controller.

In some implementations, the method, based on the result of comparing the determined ratio to the threshold ratio, determining that the determined ratio is greater than the threshold ratio, and where modifying the quantity of the first formation fluid or the second formation fluid flowed into the wellbore, can further include decreasing a flow of the first formation fluid from the first formation into the wellbore, and while decreasing the flow of the first formation fluid from the first formation into the wellbore, increasing or maintaining the flow of the second formation fluid from the second formation into the wellbore.

In some implementations, the method, based on the result of comparing the determined ratio to the threshold ratio, determining that the determined ratio is less than the threshold ratio, where modifying the quantity of the first formation fluid or the second formation fluid flowed into the wellbore, can further include increasing a flow of the first formation fluid from the first formation into the wellbore, and while increasing the flow of the first formation fluid from the first formation into the wellbore, decreasing or maintaining the flow of the second formation fluid from the second formation into the wellbore.

In some implementations, the first formation fluid and the second formation fluid are flowed into a tubular disposed within the wellbore and the threshold ratio minimizes the corrosion rate of the tubular due to the first gas or the second gas.

In some implementations, the method further includes modifying the threshold ratio of the first gas concentration to the second gas concentration for the tubular which reduces the corrosion rate in the tubular based on a tubular internal temperature.

In some implementations, the method further includes sensing the tubular internal temperature and transmitting a signal representing the tubular internal temperature to the controller.

In some implementations, the first gas is hydrogen sulfide ($H_2S$) and the second gas is carbon dioxide ($CO_2$).

In some implementations, a first formation fluid control valve is connected to the controller and configured to control flow of the first formation fluid into the wellbore is disposed within the wellbore, a second formation fluid control valve is connected to the controller and configured to control flow of the second formation fluid into the wellbore is disposed within the wellbore. Modifying the quantity of the first formation fluid or the second formation fluid flowed into the wellbore further includes opening or closing the first formation fluid control valve or the second formation fluid control valve responsive to a corresponding signal transmitted by the controller.

Further implementations of the present disclosure include a control system for controlling corrosion with wellbore fluids. The control system include one or more computer processors and a non-transitory computer-readable storage medium storing instructions executable by the one or more computer processors. The instructions when executed by the one or more computer processors cause the one or more computer processors to receive information comprising a concentration of a first gas, receive information comprising a concentration of a second gas different from the first gas, determine a ratio of a first gas concentration to a second gas concentration within the wellbore, compare the determined ratio to a threshold ratio of the first gas concentration to the second gas concentration for the wellbore which reduces a corrosion rate within the wellbore, and based on a result of comparing the determined ratio to the threshold ratio, generate a command to modify a quantity of the first formation fluid or the second formation fluid flowed into the wellbore. The first gas is in a first formation fluid and flowed from a first formation into a wellbore formed from a surface of the Earth to the first formation from a first sensor disposed in the first formation. The second gas is different from the first gas. The second gas is in a second formation fluid flowed from a second formation adjacent the first formation into the wellbore. The first gas and the second gas mix within the wellbore from a second sensor disposed in the second formation. In some implementations, the first gas is hydrogen sulfide ($H_2S$) and the second gas is carbon dioxide ($CO_2$).

In some implementations, the instructions further cause one or more computer processors, when determining the ratio of the first gas concentration to the second gas concentration within the wellbore, to receive information comprising a second concentration of the first gas within the wellbore from a third sensor and to receive information comprising a second concentration of the second gas within the wellbore from the third sensor. In some implementations, the instructions further cause one or more computer processors, based on the result of comparing the determined ratio to the threshold ratio, determining that the determined ratio is greater than the threshold ratio, where modifying the quantity of the first formation fluid or the second formation fluid flowed into the wellbore, to decrease a flow of the first formation fluid from the first formation into the wellbore and while decreasing the flow of the first formation fluid from the first formation into the wellbore, increase or maintain the flow of the second formation fluid from the second formation into the wellbore. In some implementations, where the instructions further cause one or more computer processors, based on the result of comparing the determined ratio to the threshold ratio, determining that the determined ratio is less than the threshold ratio, where modifying the quantity of the first formation fluid or the second formation fluid flowed into the wellbore, to increase a flow of the first formation fluid from the first formation into the wellbore and while increasing the flow of the first formation fluid from the first formation into the wellbore, decrease or maintain the flow of the second formation fluid from the second formation into the wellbore. In some implementations, where the instructions further cause one or more computer processors, where a first formation fluid control valve is connected to the one or more computer processors and configured to control flow of the first formation fluid into the wellbore is disposed within the wellbore, where a second formation fluid control valve is connected to the one or more computer processors and configured to control flow of the second formation fluid into the wellbore is disposed within the wellbore, and where modifying the quantity of the first formation fluid or the second formation fluid flowed into the wellbore, the instructions further cause the computer to transmit a signal to open or close the first formation fluid control valve or the second formation fluid control valve responsive to a corresponding signal transmitted by the one or more computer processors.

In some implementations, the first formation fluid and the second formation fluid are flowed into a tubular disposed within the wellbore, and the threshold ratio minimizes the corrosion rate of the tubular due to the first gas or the second gas. In some implementations, the instructions further cause one or more computer processors to modify the threshold ratio of the first gas concentration to the second gas concentration for the tubular which reduces the corrosion rate in the tubular based on a tubular internal temperature. In some implementations, the instructions further cause one or more computer processors to receive information comprising the tubular internal temperature from a third sensor.

Further implementations of the present disclosure include a corrosion control system including a controller, a first sensor, and a second sensor. The controller receives a signal representing a concentration of a first gas in a first formation fluid flowed from a first formation into a wellbore formed from a surface of the Earth to the first formation. The controller also receives a signal representing a concentration of a second gas different from the first gas, the second gas in a second formation fluid flowed from a second formation adjacent the first formation into the wellbore, wherein the first gas and the second gas mix within the wellbore. Next, the controller determines a ratio of a first gas concentration to a second gas concentration within the wellbore. The controller then compares the determined ratio to a threshold ratio of the first gas concentration to the second gas concentration for the wellbore which reduces a corrosion rate within the wellbore. Based on a result of comparing the determined ratio to the threshold ratio, the controller modifies a quantity of the first formation fluid or the second formation fluid flowed into the wellbore. The first sensor is disposed in the first formation. The first sensor senses the concentration of the first gas in the first formation fluid and transmits the signal representing the concentration of the first gas in the first formation fluid to the controller. The second sensor is disposed in the second formation. The second sensor senses the concentration of the second gas in the second formation fluid and transmits the signal representing the concentration of the second gas in the second formation fluid to the controller.

In some implementations, the controller is further configured to modify the threshold ratio of the first gas concentration to the second gas concentration for the wellbore which reduces the corrosion rate in the wellbore based on a wellbore internal temperature. The system further includes a third sensor disposed in the wellbore to sense the wellbore internal temperature and transmit a signal representing the wellbore internal temperature to the controller.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
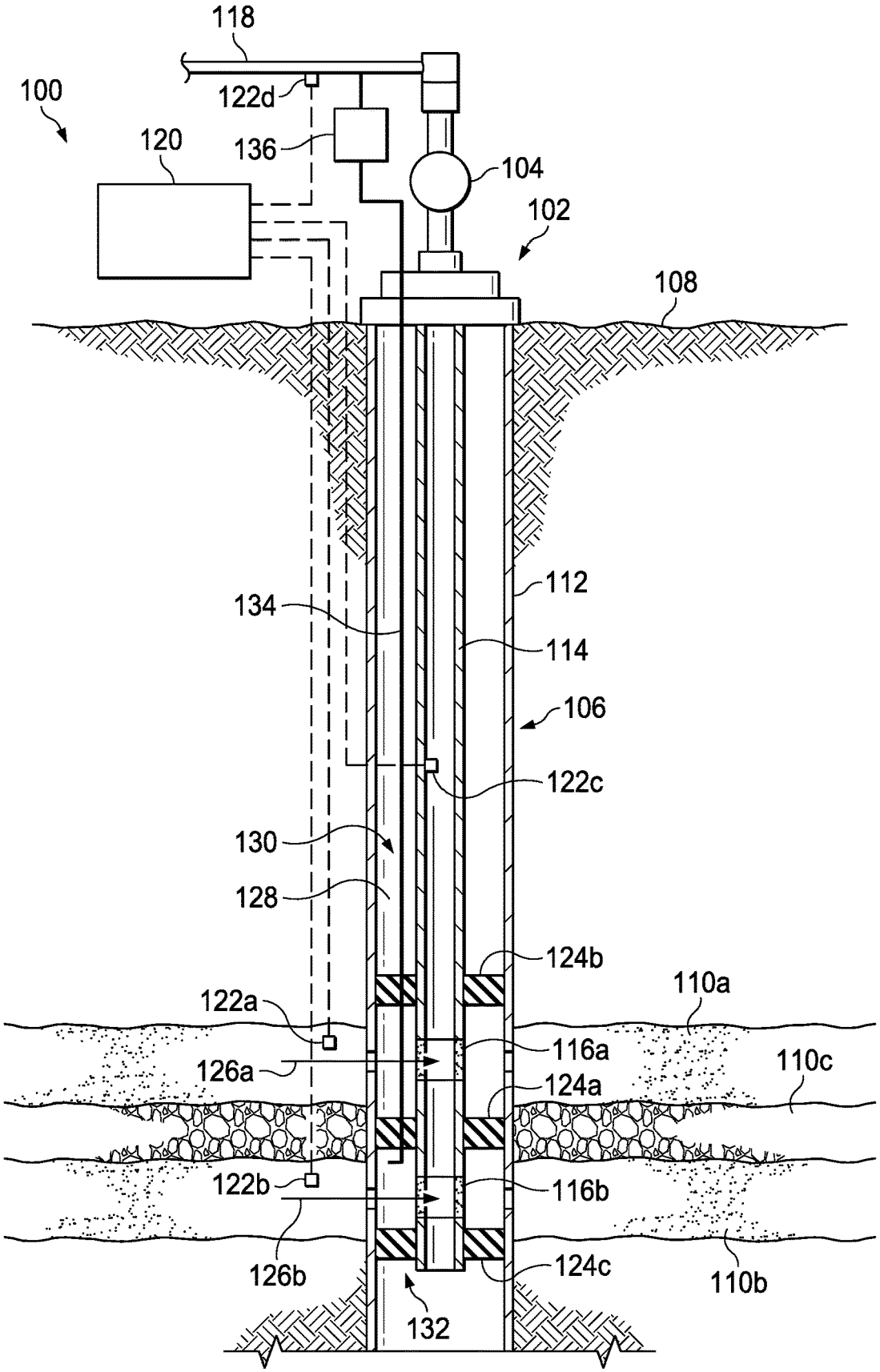
FIG. 1 is a schematic view of an example of a corrosion control system installed on a wellbore.

Formations of the Earth are filled with both liquid and gaseous phases of various fluids and chemicals including water, oils, and hydrocarbon gases. These liquid and gaseous phases of various fluids and chemicals are collectively known herein as a formation fluid. A wellbore in an oil and gas well extends from the surface of the Earth downward to the formations of the Earth. The wellbore is fluidically coupled to the formations of the Earth. A flow control device can be positioned in the wellbore to control the flow of fluids and chemicals into the wellbore. The wellbore conducts the fluids and chemicals from the formations of the Earth to the surface of the Earth through a tubular, for example, a pipe disposed within the wellbore. The tubular can be a metal casing. The tubular can be a pipe positioned within the casing such that the fluid flows through the pipe. Multiple casings can be disposed within the wellbore, with each successive casing disposed inside the previous casing and extending to a deeper depth than the previously installed casing. A wellhead is installed on the surface of the Earth and coupled to the wellbore to seal the wellbore and to control the flow of oil and gas from the wellbore through the tubular.

Once on the surface of the Earth, the fluids and chemicals can be stored or transported for refining into useable products. The fluids and chemicals can be stored in a metal storage tank. The fluids and chemicals can also be conducted directly to a fluid separation and refining facility through pipes. Some of the chemicals can cause corrosion of metal wellbore and refining facility components. Metal components that can corrode include storage tanks, pipes, fluid separators, valves, and sensors. Some corrosion can build up. Excessive buildup can cause blockages of fluid and chemical flow through components. Other corrosion can remove body material resulting in fluid and chemicals leaking, which can cause personnel injury or negatively impact the environment.

The present disclosure describes a system and a method for controlling corrosion with wellbore fluids. The corrosion control system is connected to the wellbore or a production tubulars or both. The production tubular is a tubular through which the fluid from a produced formation is flowed to the surface. The corrosion control system includes a controller and multiple sensors. The controller receives formation fluid chemical concentrations from multiple sensors, and adjusts the flow of formation fluids to reduce the corrosion rate to the wellbore or the production tubulars (or both) from the chemicals in the wellbore. The sensors are disposed in the wellbore or the production tubular (or both) to sense formation fluid chemical concentrations and conditions.

Implementations of the present disclosure realize one or more of the following advantages. Corrosion of oil and gas production and refinery components can be reduced. For example, excessive buildup inside components is reduced and component integrity is improved. Also, production efficiency is improved. For example, preventative and corrective maintenance on oil and gas production and refinery components is reduced. Equipment life can be increased, resulting in less down time between maintenance and inspections. Stable flow rates through components can be maintained longer, resulting in decreased calibration of equipment and process control corrections. Additionally, oil and gas costs can be lowered as fewer additives are required to control corrosion in oil and gas production and refinery facilities. Environmental safety is improved. For example, component integrity is increased, reducing the likelihood of an uncontrolled release of fluids and gases into the area surrounding a wellbore. The surrounding area could be the surface of the Earth when the wellhead is installed on land or the ocean when the wellhead is a subsea wellhead. Also, personnel safety is improved as component integrity is improved.

FIG. 1 shows a corrosion control system 100 installed in an oil and gas well 102. The oil and gas well 102 includes a wellbore 106. The wellbore 106 is drilled from the surface of the Earth 108 and extends downward through the formations (for example, formations 110*a*, 110*b*, and 110*c*) of the Earth. The wellbore 106 conducts a formation fluid, for example the formation fluid 126*a* and the formation fluid 126*b*, contained the formation 110*a* and formation 110*b*, respectively, of the Earth to the surface 108. By conducting, it is meant that, for example, the wellbore 106 permits flow of the formation fluid 110*a* from the formation 110*a* to the surface 108.

Some of the formations, for example, formations 110*a* and 110*b*, of the Earth are filled with both liquid and gaseous phases of various fluids and chemicals including water, oils, and different types of hydrocarbon gases. The wellbore 106 is fluidically coupled to some of the formations 110 of the Earth. Fluidically coupling a wellbore 106 to a formation (for example, 110*a* or 110*b*) allows formation fluid (126*a* or 126*b*) in that formation to flow into the wellbore 106. A first formation 110*a* is fluidically isolated from a second formation 110*b* by a third formation 110*c*. Such fluidic isolation prevents formation fluid 126*a* from one formation 110*a* from migrating directly into another formation 110*b*, because the intermediate formation (for example, the third formation 110*c*) prevents such flow. Instead, the fluids in the respective formations flow into the wellbore that is fluidically coupled to all the formations. A packer 124*a* is positioned in the wellbore annulus 128 defined by the production tubular 114 and the wellbore 106 at a location corresponding to the third formation 110*c* to fluidically isolate the first formation 110*a* from a second formation 110*b*. Additionally, a packer 124*b* can be positioned to isolate the first formation 110*a* from an uphole portion 130 of the wellbore and a packer 124*c* can be positioned to isolate the second formation from a downhole portion 132 of the wellbore 106.

In some instances, the formation fluid 126*a* has a first gas, for example, hydrogen sulfide ($H_2S$). The formation fluid 126*a* with a lower concentration of $H_2S$ is also known as a sweet crude oil due to the low sulfur content. The formation fluid 126*b* with a comparatively higher concentration of $H_2S$ is also known as a sour crude oil due to the high sulfur content. A quantity of $H_2S$ in the wellbore 106 is directly proportional to a quantity of the first formation fluid 126*a* that carries the $H_2S$ that is flowed into the wellbore 106. For example, if a large quantity of the first formation fluid 126*a* is flowed into the wellbore 106, then the sour crude oil will have a high quantity of $H_2S$. In turn, the $H_2S$ can produce sulfuric acid, which can cause corrosion in the oil and gas well 102 components as well as in the wellbore 106 or the production tubular 114 (or both).

The formation fluid 126*b* has a second gas, for example, carbon dioxide ($CO_2$). A quantity of $CO_2$ in the wellbore 106 is directly proportional to a quantity of the second formation fluid 126*b* that carries the $CO_2$ that is flowed into the wellbore 106. For example, if a large quantity of the second formation fluid 126*b* into the wellbore 106, then the crude oil will have a high quantity of $CO_2$. In turn, the $CO_2$ can produce $CO_2$ can produce carbonic acid, which can cause corrosion in the oil and gas well 102 components as well as in the wellbore 106 or the production tubular 114 (or both).

When the first formation fluid 126*a* containing a relatively higher concentration of $H_2S$ mixes with the second formation fluid 126*b* with a relatively higher $CO_2$ concentration, the balance, the acidity ratio changes. The acidity ratio is the ratio of $H_2S$ to $CO_2$. The acidity ratio guides the corrosion rate. Industry standards exist for the acidity ratio and the acceptable corrosion production rates for various oil and gas well 102 components as well as wellbore 106 components. The corrosion production rate must be below an acidity ratio in order to reduce corrosion in the wellbore. As described later, the quantities of the first formation fluid 126*a* from the first formation 110*a* and the second formation fluid 126*b* from the second formation 110*b* that are flowed into the wellbore 106 are controlled according to the respective quantities of the first and second gases carried by the respective formation fluids so that the corrosive effect of the gases on the components of the wellbore 106 are minimized.

The third formation 110*c* is situated between the first formation 110*a* and the second formation 110*b*. The third formation 110*c* provides a mechanical and fluid boundary preventing the first formation fluid 126*a* from mixing with the second formation fluid 126*b* outside the wellbore 106. The first formation fluid 126*a* and the second formation fluid 126*b* flow into the wellbore 106 and mix as they travel uphole from a downhole location to surface 108. For example, the third formation 110*c* can have few to no interconnected fractured layers, be spaced sufficiently away from each other in the Earth, or be separated by a tight cap rock formation.

The first formation 110*a* has a relatively lower $H_2S$ concentration (for example, a sweet crude oil) than the second formation 110*b*. The first formation 110*a* has a relatively higher $CO_2$ concentration than the second formation 110*b*. The second formation 110*b* has a relatively higher $H_2S$ concentration (for example, a sour crude) than the first formation 110*a*. The second formation 110*b* has a relatively lower $CO_2$ concentration than the first formation 110*a*. Other combinations of gas concentrations are also possible.

The wellbore 106 can be sealed with a casing 112. The casing 112 can have an outer diameter that depends on an inner diameter of the wellbore 106. For example, the casing 112 can have an outer diameter of 4½ inches, 5½ inches, 7 inches, 7⅝ inches, 8⅝ inches, 9⅝ inches, 10¾ inches, 11¾ inches, 13⅜ inches, 16 inches, 20 inches or other dimensions. The casing can be made of a metal, for example steel. The casing 112 can be surrounded by cement to seal the casing 112 to the formations 110 of the Earth. A production tubular 114 can be disposed in the casing 112 to conduct the first formation fluid 126*a* and second formation fluid 126*b* to the surface 108. The production tubular 114 has an outer diameter smaller than the outer diameter of the casing 112. The production tubular 114 can be metal, for example, steel.

A flow control device can be disposed in the wellbore 106 and mechanically coupled to the production tubular 114 to control the flow of fluids and chemicals into the wellbore 106 from the formations 110. For example, flow control device 116*a* and flow control device 116*b* control the first formation fluid 126*a* and the second formation flow 126*b* flow from formation 110*a* and from formation 110*b*, respectively, to the production tubular 114. The flow control device can be a screened inflow control device or a valve. For example, a valve can be a gate valve, a globe valve, a sliding sleeves, or a ball valve. The flow control device 116*a* can have an open position and a closed position. In the open position, the first formation fluid 126*a* flow is allowed from the formation 110*a* in to the tubular 114. The flow control device 116*a*. When the flow control device 116*a* is in the open position, the first formation fluid 126*a* is allowed to move from the formation 110*a* into the production tubular 114. In the closed position, the first formation fluid 126*a* flow is prevented from moving from the formation 110*a* into to the production tubular 114. The flow control device 116 can throttle the flow rate of the first formation fluid 126*a* from the formation 110*a* in to the production tubular 114 to increase or decrease the quantity and flow rate into the production tubular 114. The flow control device 116*a* can open, close, or throttle the first formation fluid 126*a* flow responsive to instructions from a control. The second formation flow control device 116*b* is substantially similar to the first formation flow control device 116*a*.

A wellhead 104 is installed on the surface 108 of the Earth and coupled to the wellbore 106 to seal the wellbore 106 and to control the flow of oil and gas from the wellbore 106. The wellhead 104 can include multiple components including isolation valves, chokes, and spools to control and direct the flow of the first formation fluid 126*a* and the second formation fluid 126*b*. Once on the surface 108 of the Earth, the first formation fluid 126*a* and the second formation fluid 126*b* can be directed to facilities to be stored or refined into useable products. The first formation fluid 126*a* and the second formation fluid 126*b* can be stored in a metal storage tank at the well site. The first formation fluid 126*a* and the second formation fluid 126*b* can also be conducted directly to a fluid separation and refining facility through pipelines 118. The pipelines 118 can include pipes in the refining facility.

Multiple sensors are disposed within the well 102, for example, within the wellbore 102, within the tubular 114, at other locations, or any combination of them. For example, a first sensor 122*a* is positioned in the first formation 110*a*. The first sensor 122*a* can be an electro-chemical sensor, electrochemical amperometric sensor, an infrared chemical sensor, optical fiber sensor, a gas liquid chromatographic sensor, a piezoelectric effect based mass sensor or a similar sensor that can sense the concentration of the first gas. The first sensor 122*a* in the well can function similar to a litmus paper test for identification of gasses. The first sensor 122*a* can be calibrated digitally to determine the percentage concentration of $H_2S$ and $CO_2$. The sensor 122*a* can also sense the concentration of the second gas. The sensor 122*a* can measure other properties such as flow rate, pressure, temperature, conductivity, pH, or other properties. The sensor 122*a* can transmit signals representing the concentration of the first gas, the concentration of the second gas, and these other properties to a controller 120. The sensor 122*a* can be a single sensor or a sensor assembly or sensor array with multiple sensors, each configured to sense and measure properties of the first formation fluid 126*a* and the second formation fluid 126*b*. Additionally sensors 122*b*, 122*c*, and 122*d* substantially similar to the first sensor 122*a* can be coupled to the controller. The sensor 122*b* is positioned in the second formation 110*b* and configured to sense the concentration of the second gas. Sensor 122*c* is positioned in the production tubular 114 to sense the concentration of the first gas and the second gas in the production tubular 114. Alternatively, the sensor 122*c* can be positioned in the casing 112 and configured to sense the concentration of the first gas and the second gas in the casing 112. The sensor 122*d* is positioned in the pipeline 118 and configured to sense the concentration of the first gas and the second gas in the casing 112. In some cases, multiple sensors can be positioned both in the wellbore 106 at different depths or the pipeline 118 at different locations to sense the concentration of the first gas and the second gas.

Alternatively, a sampling conduit 134 can be disposed in the wellbore 106 and fluidically coupled to the first formation 110*a* and the second formation 110*b*. The sampling conduit can conduct a small quantity of the first formation fluid 126*a*, a small quantity of the second formation 126*b*, or both, to the surface 108. Once on the surface 108, the small quantity of the first formation fluid 126*a*, the small quantity of the second formation 126*b*, or both, can be analyzed by a combined $CO_2/H_2S$ analyzer 136. The sensors for a combined $CO_2/H_2S$ analyzer 136 are positioned in the wellbore 106 to capture dynamic $H_2S$ and $CO_2$ readings. The data representing the dynamic $H_2S$ and $CO_2$ readings are transmitted to a surface console, which iteratively determines the acidity ratios. The calculated average acidity ratio at a particular time will trigger the opening and closing of flow control device 116*a* and flow control device 116*b*. The $H_2S/CO_2$ ratio is dynamically maintained as the well is produced below a safe acidity ratio threshold by adjusting the flow control device 116*a* and flow control device 116*b*. The $CO_2/H_2S$ analyzer 136 can include sensor 122*d*.

The corrosion control system 100 includes a controller 120. The controller 120 can be a non-transitory computer-readable medium storing instructions executable by one or more processors to perform operations described here. The controller 174 can include firmware, software, hardware or combinations of them. The instructions, when executed by the one or more computer processors, cause the one or more computer processors to perform operations described here. The controller 120 can be disposed in the wellbore 106, on the surface 108, or on the surface 108 and at a remote location. The controller 120 receives a signal representing a concentration of a first gas in the first formation 110*a* fluid from a first sensor 122*a*. The first gas can be $CO_2$ gas. The controller 120 also can receives a signal representing a concentration of a second gas in the second formation 110*b* from a second sensor 122*b*. The second gas can be $H_2S$ gas. The first sensor 122*a* and the second gas sensor 122*b* can sense conditions dynamically or over a timed period. The mathematic ratio of $H_2S$ percentage concentration to $CO_2$ percentage concentration determines the acidity ratio. The first sensor 122*a* and the second sensor 122*b* sensed conditions are independently captured and the acidity ratio is generated by the controller 120. The sequence of opening and closing of the flow control devices 116*a* and 116*b* are then subsequently determined by the acidity ratio. The controller 120 can be coupled to the $CO_2/H_2S$ analyzer 136 and receive the signal representing the concentration of a first gas in the first formation 110*a* fluid, the signal representing a concentration of the second gas in the second formation 110*b*, or a signal representing the ratio of the first gas concentration to the second gas concentration from the $CO_2/H_2S$ analyzer 136. Alternatively, the controller 120 can include the $CO_2/H_2S$ analyzer 136.

The controller 120 can determine a ratio of a first gas concentration to a second gas concentration. For example, the controller 120 can determine the ratio of the $CO_2$ gas concentration to $H_2S$ gas concentration within the wellbore 106. The formation containing the sweet gas will have higher $CO_2$, while the formation containing the sour gas will have higher $H_2S$ concentration. The first sensor 122*a* and the second sensor 122*b* will capture the percentage concentrations of the sweet gas and the sour gas during flow upwards to the surface through the wellbore 106. The controller will calculate the ratio of the $CO_2$ gas concentration to $H_2S$ gas concentration. Alternatively, the controller can determine the ratio of the $H_2S$ gas concentration to the $CO_2$ gas concentration.

The controller 120 compares the determined ratio to a threshold ratio of the $CO_2$ gas concentration to the $H_2S$ gas concentration for the wellbore 106 which reduces a corrosion rate within the wellbore. A predetermined variation between the threshold ratio of the $CO_2$ gas concentration to the $H_2S$ gas concentration for the wellbore 106 based metallurgy of the oil and gas well 102 components as well as wellbore 106 components and operating conditions within those components. For example, a difference between the $CO_2$ gas concentration to the $H_2S$ gas concentration can be plus or minus five percent. The calculated ratio of the $CO_2$ gas concentration to the $H_2S$ gas concentration should be below a safe threshold. The threshold ratio of the $CO_2$ gas concentration to the $H_2S$ gas concentration is selected based on the material properties of the wellbore 106 to which the first formation fluid 126*a* and the second formation fluid 126*b* is exposed. The metallurgy of the oil and gas well 102 components as well as wellbore 106 components and operating conditions of the wellbore 106 can be included in the selection of the threshold ratio. The threshold ratio is stored in the computer-readable medium of the controller 120 or in some other computer-readable memory connected and accessible to the controller 120. Based on a result of comparing the determined ratio to the threshold ratio, the controller 120 modifies a quantity of the first formation 110*a* fluid or the second formation 110*b* fluid flowed into the wellbore 106. A threshold will be determined, for example an acidity ratio of 0.5. Once the calculated acidity ratios at surface reaches more than 0.5 (1:2), the $H_2S$ flow control valve 116*b* will be shut or throttled to reduce flow to reduce the $H_2S$ % concentration. The controller 120 modifies the quantity of the first formation fluid 126*a* flowed into the wellbore 106 by actuating open or close the first formation flow control device 116*a*. For example, the first formation flow control device 116*a* can be partially opened, fully opened, partially closed, or fully closed. The extent to which the first formation flow control device 116*a* can be opened or closed is determined by the difference between the acidity ratio and the predetermined safe threshold. The controller 120 modifies the quantity of the second formation fluid 126*b* flowed into the wellbore 106 by actuating open or close the second formation flow control device 116*b*, substantially similar to the first formation flow control device 116*a*. Modifying the quantity of the first formation fluid 126*a* flowed into the wellbore 106 modifies a quantity of gases carried by the first formation fluid 126*a* into the wellbore 106 which, in turn, modifies a concentration of the gases in the wellbore 106. Additionally, the controller 120 can be configured to modify the threshold ratio of the $CO_2$ gas concentration to the $H_2S$ gas concentration for wellbore 106 which reduces the corrosion rate based on a temperature received from the third sensor 122*c*.

The controller 120, after causing the first formation fluid control device 116*a* to open, can continue monitoring the ratio of the $H_2S$ concentration to the $CO_2$ concentration and determine an updated ratio of the $H_2S$ concentration to the $CO_2$ concentration. Upon determining that the determined ratio has reached the threshold $H_2S/CO_2$ ratio, the controller 120 can transmit a signal to the first formation fluid control device 116*a* to close. The controller 120, after causing the first formation fluid control device 116*a* to close, can continue monitoring the ratio of the $H_2S$ concentration to the $CO_2$ concentration and determine an updated ratio of the $H_2S$ concentration to the $CO_2$ concentration. Upon determining that the determined ratio has reached the threshold $H_2S/CO_2$ ratio, the controller 120 can cause the first formation fluid control device 116*a* to open.

The controller 120, after causing the second formation fluid control device 116*b* to close, can continue monitoring the ratio of the $H_2S$ concentration to the $CO_2$ concentration and determine an updated ratio of the $H_2S$ concentration to the $CO_2$ concentration. Upon determining that the determined ratio has reached the threshold $H_2S/CO_2$ ratio, the controller 120 can transmit a signal to the second formation fluid control device 116*b* to open. The controller 120, after causing the second formation fluid control device to open, can continue monitoring the ratio of the $H_2S$ concentration to the $CO_2$ concentration and determine an updated ratio of the $H_2S$ concentration to the $CO_2$ concentration. Upon determining that the determined ratio has reached the threshold $H_2S/CO_2$ ratio, the controller 120 can cause the second formation fluid control device 116*b* to close.

The techniques described here can be implemented to control corrosion of the casing 112 itself. That is, there need not be a production tubular 114 in the wellbore 106. All sensors can be attached to the casing 112, and the first formation fluid 126*a* and the second formation fluid flow

126*b* flow from the first formation 110*a* and the second formation 110*b* can be controlled based on corrosion of the casing 112 metal itself.

Figure 2:
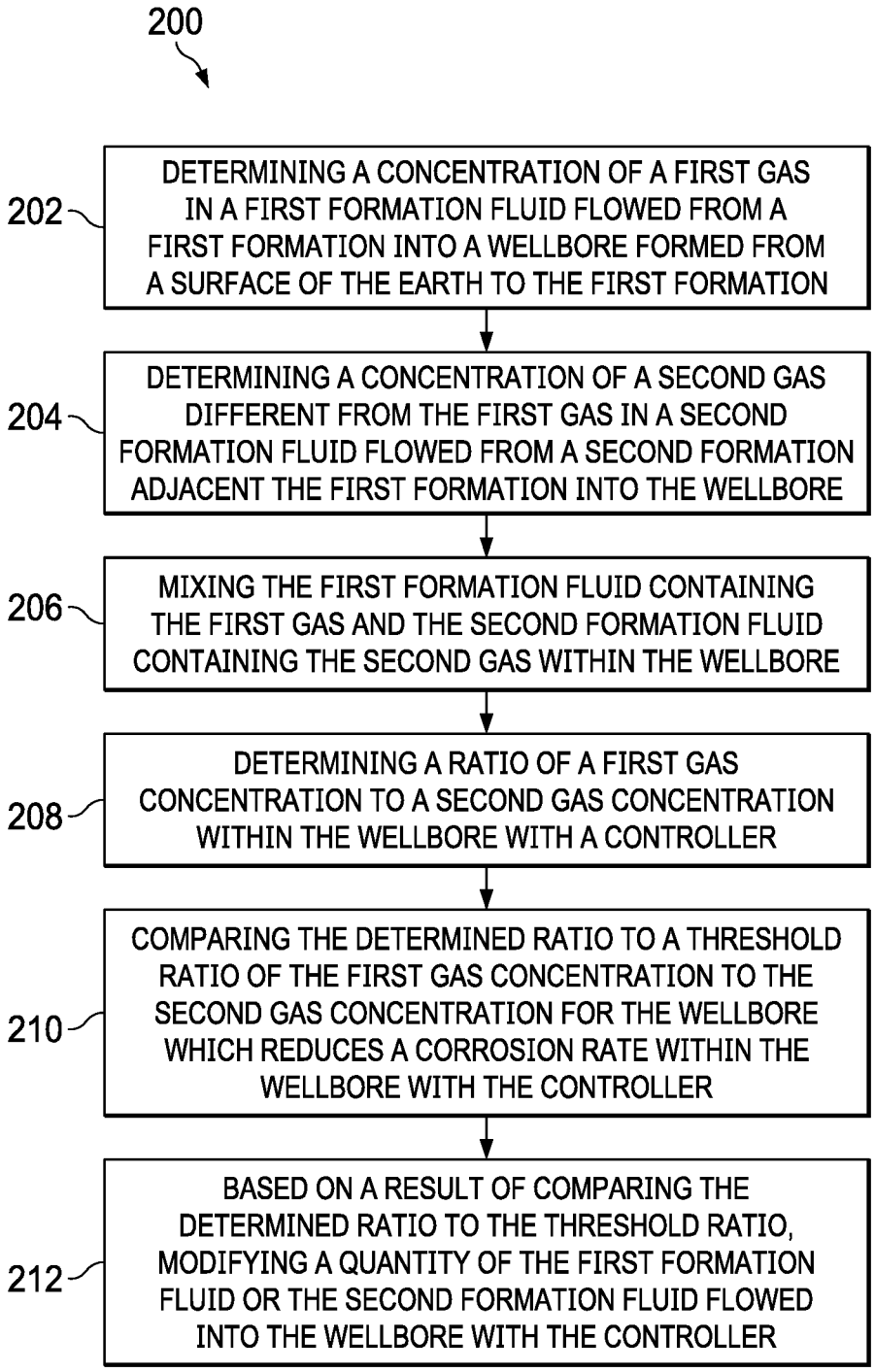
FIG. 2 is a flow chart of an example of a method of controlling corrosion within the wellbore using the corrosion control system of FIG. 1.

FIG. 2 is a flow chart of an example method 200 of controlling corrosion with a corrosion control system according to the implementations of the present disclosure. At 202, a concentration of a first gas in a first formation fluid flowed from a first formation into a wellbore formed from a surface of the Earth to the first formation is determined. For example, the first gas can be hydrogen sulfide ($H_2S$). The concentration of the first gas can be determined by a controller. The controller receives a signal from a sensor disposed in the first formation of the Earth. The signal can include the concentration of the first gas, the concentration of another gas, the concentration of multiple gases, flow rate, pressure, temperature, conductivity, pH, or other properties of the first formation fluid. At 204, a concentration of a second gas different from the first gas in a second formation fluid flowed from a second formation adjacent the first formation into the wellbore is determined. For example, the second gas can be carbon dioxide ($CO_2$). The concentration of the second gas can be determined by the controller. The controller receives a signal from a sensor disposed in the second formation of the Earth. The signal can include the concentration of the second gas, the concentration of another gas, the concentration of multiple gases, flow rate, pressure, temperature, conductivity, pH, or other properties of the second formation fluid.

At 206, the first formation fluid containing the first gas and the second formation fluid containing the second gas are mixed within the wellbore. For example, the first formation fluid and the second formation fluid can mix with each other upon flowing into the wellbore. As the formation fluids mix, the first gas and the second gas also mix. The mixed gas concentration in the mixture is represented by a first gas concentration and a second gas concentration. At 208, a ratio of a first gas concentration to a second gas concentration within the wellbore is determined by the controller. In some implementations, the controller starts the ratio determination and valve open/close operations once the flow and mixing has stabilized before triggering the ratio determination and valve open/closing operations. For example, the sensor that determined the concentration of the first gas and the sensor that determined the concentration of the second gas determine the first gas concentration and the second gas concentration, respectively, in the mixture, and transmit the determined gas concentrations to the controller. The controller determines the ratio of the first gas concentration and the second gas concentration by dividing the first gas concentration by the second gas concentration. In other words, the ratio is $H_2S$ % concentration/$CO_2$% concentration.

At 210, the determined ratio is compared to a threshold ratio of the first gas concentration to the second gas concentration for the wellbore which reduces a corrosion rate within the wellbore with the controller. The values do not need to match exactly. For example, an acceptable variation can be plus or minus five percent. For example, the threshold ratio of the first gas concentration to the second gas concentration at or below which corrosion in the wellbore (specifically, in the casing) can depend on the material with which the casing is made, the well conditions of the well in which the casing is disposed, other factors or combinations of them. Based on these factors or on manufacturer's specifications (or both), the threshold ratio can be selected to minimize the corrosion rate of the tubular due to the first gas or the second gas or both. In instances in which corrosion within a tubular disposed in the wellbore is being controlled, the threshold ratio of the first gas concentration to the second gas concentration for the tubular which reduces the corrosion rate in the tubular can be modified based on a tubular internal temperature. The tubular internal temperature can be sensed by a sensor and a signal representing the tubular internal temperature can be transmitted to the controller.

At 212, based on a result of comparing the determined ratio to the threshold ratio, a quantity of the first formation fluid or the second formation fluid flowed into the wellbore can be modified with the controller. The determined ratio is maintained below the threshold ratio by determining which of the gas concentration needed to be adjusted to reduce the acidity ratio down to the threshold. For example, it could be to reduce $H_2S$ or increase $CO_2$. For example, based on the result of comparing the determined ratio to the threshold ratio, determining that the determined ratio is greater than the threshold ratio, the controller can decrease a flow of the first formation fluid from the first formation into the wellbore, and while decreasing the flow of the first formation fluid from the first formation into the wellbore, increase or maintain the flow of the second formation fluid from the second formation into the wellbore. For example, based on the result of comparing the determined ratio to the threshold ratio and determining that the determined ratio is less than the threshold ratio, the controller can increase a flow of the first formation fluid from the first formation into the wellbore, and while increasing the flow of the first formation fluid from the first formation into the wellbore, decrease or maintain the flow of the second formation fluid from the second formation into the wellbore. For example, a first formation fluid control valve can be connected to the controller and configured to control flow of the first formation fluid into the wellbore and disposed within the wellbore. A second formation fluid control valve can be connected to the controller and configured to control flow of the second formation fluid into the wellbore and disposed within the wellbore. To modify the quantity of the first formation fluid or the second formation fluid flowed into the wellbore, the controller can open or close the first formation fluid control valve or the second formation fluid control valve responsive to a corresponding signal transmitted by the controller. In some implementations, the controller can determine a quantity by which a gas concentration needs to be increased or decreased based on a difference between the determined ratio and the threshold ratio. The controller can also determine a rate at which the gas concentration is increasing within the wellbore based on a flow rate of the formation fluid into the wellbore. Using this information, the controller can determine an expected flow rate of either or both formation fluids that will tend to change the determined ratio toward the threshold ratio. The controller can generate a signal that will cause the flow control device that controls flow of the formation fluid into the wellbore to modify the actual flow rate of the formation fluid to the preferred flow rate, for example, by partially opening or partially closing the flow control device. The opening and closing are determined by how much is the current ratio is above the threshold ratio. The open and closing can be a gradual process until the desired threshold is reached. When the valve opens or closes, new readings are taken and used to determine if the flow control valves need to close or open more.

Certain implementations have been described to control corrosion in a wellbore 106, specifically, in a casing 112 of a wellbore 106. The techniques described here can alternatively or additionally be implemented to control corrosion in other components of a wellbore 106, for example, a production tubular 114 disposed in the wellbore 106, a pipeline 118, the wellhead 104, storage tanks, fluid separators, valves, or other components. For each such implementation, sensors described earlier as being disposed in the casing 112 can be disposed within specific wellbore 106 components in which corrosion is to be controlled.

For example, the controller 120 can receive a signal representing the $CO_2$ and $H_2S$ concentration in the production tubular 114 from a third sensor 122*c* positioned downhole in the production tubular 114. The controller 120 can also determine the ratio of $CO_2$ gas concentration to $H_2S$ gas concentration within the production tubular 114 from signals received from the third sensor 122*c*. The threshold ratio of the $CO_2$ gas concentration to the $H_2S$ gas concentration is selected based on the material properties of the production tubular 114 and conditions to which the production tubular 114 is exposed.

For example, a fourth sensor 122*d* can be positioned in the pipeline 118 on the surface 108. The controller 120 can also determine the ratio of $CO_2$ gas concentration to $H_2S$ gas concentration within the pipeline 118 from signals received from the fourth sensor 122*d*. The threshold ratio of the $CO_2$ gas concentration to the $H_2S$ gas concentration is selected based on the material properties of the pipeline 118 and conditions to which the pipeline 118 is exposed.

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations. For example, the implementations are described with reference to a tee pipe fitting. However, the disclosure can be implemented with any appropriate pipe fitting that connects two or more pipes flowing fluids of different pressures.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents

The invention claimed is:

1. A corrosion control method comprising:

determining a concentration of a first gas in a first formation fluid flowed from a first formation into a wellbore formed from a surface of the Earth to the first formation;

determining a concentration of a second gas different from the first gas, the second gas in a second formation fluid flowed from a second formation adjacent the first formation into the wellbore, wherein the first gas and the second gas mix within the wellbore, wherein the first formation fluid and the second formation fluid are flowed into a tubular disposed within the wellbore;

determining a ratio of a first gas concentration to a second gas concentration within the wellbore with a controller;

comparing the determined ratio to a threshold ratio of the first gas concentration to the second gas concentration for the wellbore which reduces a corrosion rate within the wellbore with the controller, wherein the threshold ratio minimizes the corrosion rate of the tubular due to the first gas or the second gas;

modifying the threshold ratio of the first gas concentration to the second gas concentration for the tubular which reduces the corrosion rate in the tubular based on a tubular internal temperature; and based on a result of comparing the determined ratio to the threshold ratio, modifying a quantity of the first formation fluid or the second formation fluid flowed into the wellbore with the controller.

2. The method of claim 1, wherein determining the ratio of the first gas concentration to the second gas concentration within the wellbore comprises:

sensing a second concentration of the first gas within the wellbore;

transmitting a signal representing the second concentration of the first gas to the controller;

sensing a second concentration of the second gas within the wellbore; and transmitting a signal representing the second concentration of the second gas to the controller.

3. The method of claim 1, further comprising, based on the result of comparing the determined ratio to the threshold ratio, determining that the determined ratio is greater than the threshold ratio, wherein modifying the quantity of the first formation fluid or the second formation fluid flowed into the wellbore comprises:

decreasing a flow of the first formation fluid from the first formation into the wellbore; and while decreasing the flow of the first formation fluid from the first formation into the wellbore, increasing or maintaining the flow of the second formation fluid from the second formation into the wellbore.

4. The method of claim 1, further comprising, based on the result of comparing the determined ratio to the threshold ratio, determining that the determined ratio is less than the threshold ratio, wherein modifying the quantity of the first formation fluid or the second formation fluid flowed into the wellbore comprises:

increasing a flow of the first formation fluid from the first formation into the wellbore; and while increasing the flow of the first formation fluid from the first formation into the wellbore, decreasing or maintaining the flow of the second formation fluid from the second formation into the wellbore.

5. The method of claim 1, further comprising:

Sensing the tubular internal temperature; and

Transmitting a signal representing the tubular internal temperature to the controller.

6. The method of claim 1, wherein the first gas is hydrogen sulfide ($H_2S$) and the second gas is carbon dioxide ($CO_2$).

7. The method of claim 1, wherein a first formation fluid control valve connected to the controller and configured to control flow of the first formation fluid into the wellbore is disposed within the wellbore, wherein a second formation fluid control valve connected to the controller and configured to control flow of the second formation fluid into the wellbore is disposed within the wellbore, wherein modifying the quantity of the first formation fluid or the second formation fluid flowed into the wellbore comprises opening or closing the first formation fluid control valve or the second formation fluid control valve responsive to a corresponding signal transmitted by the controller.

8. A control system comprising:

one or more computer processors; and a non-transitory computer-readable storage medium storing instructions executable by the one or more computer processors, the instructions when executed by the one or more computer processors cause the one or more computer processors to:

receive information comprising a concentration of a first gas in a first formation fluid flowed from a first formation into a wellbore formed from a surface of the Earth to the first formation from a first sensor disposed in the first formation;

receive information comprising a concentration of a second gas different from the first gas, the second gas in a second formation fluid flowed from a second formation adjacent the first formation into the wellbore, wherein the first gas and the second gas mix within the wellbore from a second sensor disposed in the second formation, wherein the first formation fluid and the second formation fluid are flowed into a tubular disposed within the wellbore;

determine a ratio of a first gas concentration to a second gas concentration within the wellbore;

compare the determined ratio to a threshold ratio of the first gas concentration to the second gas concentration for the wellbore which reduces a corrosion rate within the wellbore, wherein the threshold ratio minimizes the corrosion rate of the tubular due to the first gas or the second gas;

modify the threshold ratio of the first gas concentration to the second gas concentration for the tubular which reduces the corrosion rate in the tubular based on a tubular internal temperature; and based on a result of comparing the determined ratio to the threshold ratio, generate a command to modify a quantity of the first formation fluid or the second formation fluid flowed into the wellbore.

9. The system of claim 8, wherein the instructions further cause one or more computer processors, when determining the ratio of the first gas concentration to the second gas concentration within the wellbore, to:

receive information comprising a second concentration of the first gas within the wellbore from a third sensor; and receive information comprising a second concentration of the second gas within the wellbore from the third sensor.

10. The system of claim 8, wherein the instructions further cause one or more computer processors, based on the result of comparing the determined ratio to the threshold ratio, determining that the determined ratio is greater than the threshold ratio, wherein modifying the quantity of the first formation fluid or the second formation fluid flowed into the wellbore, to:

decrease a flow of the first formation fluid from the first formation into the wellbore; and while decreasing the flow of the first formation fluid from the first formation into the wellbore, increase or maintain the flow of the second formation fluid from the second formation into the wellbore.

11. The system of claim 8, wherein the instructions further cause one or more computer processors, based on the result of comparing the determined ratio to the threshold ratio, determining that the determined ratio is less than the threshold ratio, wherein modifying the quantity of the first formation fluid or the second formation fluid flowed into the wellbore, to:

increase a flow of the first formation fluid from the first formation into the wellbore; and while increasing the flow of the first formation fluid from the first formation into the wellbore, decrease or maintain the flow of the second formation fluid from the second formation into the wellbore.

12. The system of claim 8, wherein the instructions further cause one or more computer processors to receive information comprising the tubular internal temperature from a third sensor.

13. The system of claim 8, wherein the first gas is hydrogen sulfide ($H_2S$) and the second gas is carbon dioxide ($CO_2$).

14. The system of claim 8, wherein the instructions further cause one or more computer processors, wherein a first formation fluid control valve is connected to the one or more computer processors and configured to control flow of the first formation fluid into the wellbore is disposed within the wellbore, wherein a second formation fluid control valve is connected to the one or more computer processors and configured to control flow of the second formation fluid into the wellbore is disposed within the wellbore, and wherein modifying the quantity of the first formation fluid or the second formation fluid flowed into the wellbore, to transmit a signal to open or close the first formation fluid control valve or the second formation fluid control valve responsive to a corresponding signal transmitted by the one or more computer processors.

15. A corrosion control system comprising:

a controller configured to:

receive a signal representing a concentration of a first gas in a first formation fluid flowed from a first formation into a wellbore formed from a surface of the Earth to the first formation;

receive a signal representing a concentration of a second gas different from the first gas, the second gas in a second formation fluid flowed from a second formation adjacent the first formation into the wellbore, wherein the first gas and the second gas mix within the wellbore, wherein the first formation fluid and the second formation fluid are flowed into a tubular disposed within the wellbore;

determine a ratio of a first gas concentration to a second gas concentration within the wellbore;

compare the determined ratio to a threshold ratio of the first gas concentration to the second gas concentration for the wellbore which reduces a corrosion rate within the wellbore, wherein the threshold ratio minimizes the corrosion rate of the tubular due to the first gas or the second gas;

modify the threshold ratio of the first gas concentration to the second gas concentration for the tubular which reduces the corrosion rate in the tubular based on a tubular internal temperature; and based on a result of comparing the determined ratio to the threshold ratio, modify a quantity of the first formation fluid or the second formation fluid flowed into the wellbore;

a first sensor disposed in the first formation configured to:

sense the concentration of the first gas in the first formation fluid; and transmit the signal representing the concentration of the first gas in the first formation fluid to the controller;

a second sensor disposed in the second formation configured to:

sense the concentration of the second gas in the second formation fluid; and transmit the signal representing the concentration of the second gas in the second formation fluid to the controller; and a third sensor disposed in the wellbore configured to:

sense the wellbore internal temperature; and transmit a signal representing the wellbore internal temperature to the controller.

* * * * *